US008503905B2

(12) United States Patent
Shinshi et al.

(10) Patent No.: US 8,503,905 B2
(45) Date of Patent: Aug. 6, 2013

(54) FIXING DEVICE AND IMAGE FORMING APPARATUS

(75) Inventors: Akira Shinshi, Tokyo (JP); Yasunori Ishigaya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 213 days.

(21) Appl. No.: 13/144,704

(22) PCT Filed: Nov. 5, 2009

(86) PCT No.: PCT/JP2009/069235

§ 371 (c)(1),
(2), (4) Date: Jul. 15, 2011

(87) PCT Pub. No.: WO2010/092720

PCT Pub. Date: Aug. 19, 2010

(65) Prior Publication Data

US 2011/0274473 A1 Nov. 10, 2011

(30) Foreign Application Priority Data

Feb. 12, 2009 (JP) ..... 2009-029330

(51) Int. Cl.
*G03G 15/00* (2006.01)
*G03G 15/20* (2006.01)

(52) U.S. Cl.
USPC ..... 399/107; 399/329

(58) Field of Classification Search
USPC ..... 399/67, 69, 70, 122, 320, 328, 329, 399/107
See application file for complete search history.

(56) References Cited

U.S. PATENT DOCUMENTS

| | | | | |
|---|---|---|---|---|
| 5,926,199 | A * | 7/1999 | Matoba et al. | 347/204 |
| 2007/0292175 | A1 | 12/2007 | Shinshi | |
| 2008/0112739 | A1 | 5/2008 | Shinshi | |
| 2008/0175633 | A1 | 7/2008 | Shinshi | |
| 2008/0187371 | A1 | 8/2008 | Tsai et al. | |
| 2008/0219730 | A1 | 9/2008 | Shinshi | |
| 2008/0253788 | A1 | 10/2008 | Shinshi | |
| 2008/0298862 | A1 | 12/2008 | Shinshi | |
| 2009/0123202 | A1 | 5/2009 | Yoshinaga et al. | |

(Continued)

FOREIGN PATENT DOCUMENTS

| | | |
|---|---|---|
| JP | 2006 234864 | 9/2006 |
| JP | 2007 108392 | 4/2007 |

(Continued)

OTHER PUBLICATIONS

International Search Report issued Dec. 15, 2009 in PCT/JP09/069235 filed Nov. 5, 2009.

*Primary Examiner* — David Gray
*Assistant Examiner* — Sevan A Aydin
(74) *Attorney, Agent, or Firm* — Oblon, Spivak, McClelland, Maier & Neustadt, L.L.P.

(57) ABSTRACT

A fixing device includes a flexible endless fixing member; a metal member; and a pressing member. "A" is equal to or less than "Bmax" and greater than "Bave" ("Bmax"≧"A">"Bave"), where "A" represents an amount of a clearance at the time of normal temperature between the fixing member and the metal member, "Bmax" represents a maximum amount of deformation generated in the metal member when heating is started by the heating member from a normal temperature state, and "Bave" represents an amount of stable deformation generated in the metal member when the temperature of the entire metal member becomes even.

4 Claims, 7 Drawing Sheets

U.S. PATENT DOCUMENTS

| | | | | |
|---|---|---|---|---|
| 2009/0245865 | A1 | 10/2009 | Shinshi et al. | |
| 2009/0311016 | A1 | 12/2009 | Shinshi | |
| 2010/0092220 | A1 | 4/2010 | Hasegawa et al. | |
| 2010/0092221 | A1 | 4/2010 | Shinshi et al. | |
| 2011/0058862 | A1 | 3/2011 | Hasegawa et al. | |
| 2011/0170918 | A1 * | 7/2011 | Takagi et al. | 399/329 |
| 2011/0222929 | A1 | 9/2011 | Fujimoto et al. | |
| 2011/0229200 | A1 | 9/2011 | Yamaguchi et al. | |

FOREIGN PATENT DOCUMENTS

| | | |
|---|---|---|
| JP | 2007 334205 | 12/2007 |
| JP | 2008 158482 | 7/2008 |
| JP | 2008 191633 | 8/2008 |

* cited by examiner

FIXING DEVICE AND IMAGE FORMING APPARATUS

TECHNICAL FIELD

The present invention generally relates to fixing devices and image forming apparatuses. More particularly, the present invention relates to an image forming apparatus such as a copier, a printer, a facsimile machine, a multi-function printer thereof or the like and a fixing device provided in the image forming apparatus.

BACKGROUND ART

Conventionally, a fixing device, used for an image forming apparatus such as a copier or printer, where a warming-up time or a first printing time is short and bad fixing may not happen even if a process of the apparatus is made to speed up has been known. See, for example, Japanese Patent Application Publication No. 2008-158482.

More specifically, the fixing device discussed in, for example, Japanese Patent Application Publication No. 2008-158482, there are a fixing belt as a fixing member, a metal member as a facing member, a heater as a heating member, a pressing roller as a pressing member, and others. The metal member having a substantially cylindrical shape is fixed so as to face a part or an entirety of an internal circumferential surface of the fixing member. The heater is provided inside the metal member so as to heat the metal member. The pressing roller presses the fixing belt so that a nip part is formed.

The fixing belt is heated by the metal member heated by the heater so that a toner image on a recording medium conveyed to the nip part receives heat and pressure at the nip part. As a result of this, the toner image is fixed on the recording medium.

In the fixing device discussed in, for example, Japanese Patent Application Publication No. 2008-158482, if a clearance amount (facing distance) between the fixing belt (fixing member) and the metal member is too large, heating efficiency of the fixing belt cannot be sufficiently improved. If the clearance amount between the fixing belt and the metal member is too small, the fixing belt may make sliding contact with the metal member so as to become worn at the time of operation of the image forming apparatus.

DISCLOSURE OF THE INVENTION

Accordingly, embodiments of the present invention may provide a novel and useful fixing device and image forming apparatus solving one or more of the problems discussed above.

More specifically, the embodiments of the present invention may provide a fixing device and an image forming apparatus whereby a warming-up time or a first printing time is short; bad fixing does not happen even if a process of the apparatus is made to speed up; heating efficiency of the fixing member is sufficiently high; and the likelihood of generating a problem where a fixing member makes sliding contact with a metal member so as to become worn at the time of operation of the image forming apparatus is reduced.

Another aspect of the embodiments of the present invention may be to provide a fixing device including: a flexible endless fixing member configured to move in a designated direction and heat a toner image so as to melt the toner image; a metal member fixedly provided so as to face an internal circumferential surface of the fixing member with a clearance and configured to heat the fixing member, the metal member being heated by a heating part; and a pressing member configured to press and contact the fixing member so as to form a nip part where a recording medium is conveyed, wherein "A" is equal to or less than "$B_{max}$" and greater than "$B_{ave}$" ("$B_{max}$"≧"A">"$B_{ave}$"), where "A" represents an amount of a clearance at the time of normal temperature between the fixing member and the metal member, "$B_{max}$" represents a maximum amount of deformation generated in the metal member when heating is started by the heating member from a normal temperature state, and "$B_{ave}$" represents an amount of stable deformation generated in the metal member when the temperature of the entire metal member becomes even.

Another aspect of the embodiments of the present invention may be to provide an image forming apparatus, including: a fixing device including a flexible endless fixing member configured to move in a designated direction and heat a toner image so as to melt the toner image; a metal member fixedly provided so as to face an internal circumferential surface of the fixing member with a clearance and configured to heat the fixing member, the metal member being heated by a heating part; and a pressing member configured to press and contact the fixing member so as to form a nip part where a recording medium is conveyed, wherein "A" is equal to or less than "$B_{max}$" and greater than "$B_{ave}$" ("$B_{max}$"≧"A">"$B_{ave}$"), where "A" represents an amount of a clearance at the time of normal temperature between the fixing member and the metal member, "$B_{max}$" represents a maximum amount of deformation generated in the metal member when heating is started by the heating member from a normal temperature state, and "$B_{ave}$" represents an amount of stable deformation generated in the metal member when the temperature of the entire metal member becomes even.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

BEST MODE FOR CARRYING OUT THE INVENTION

Figure 1:
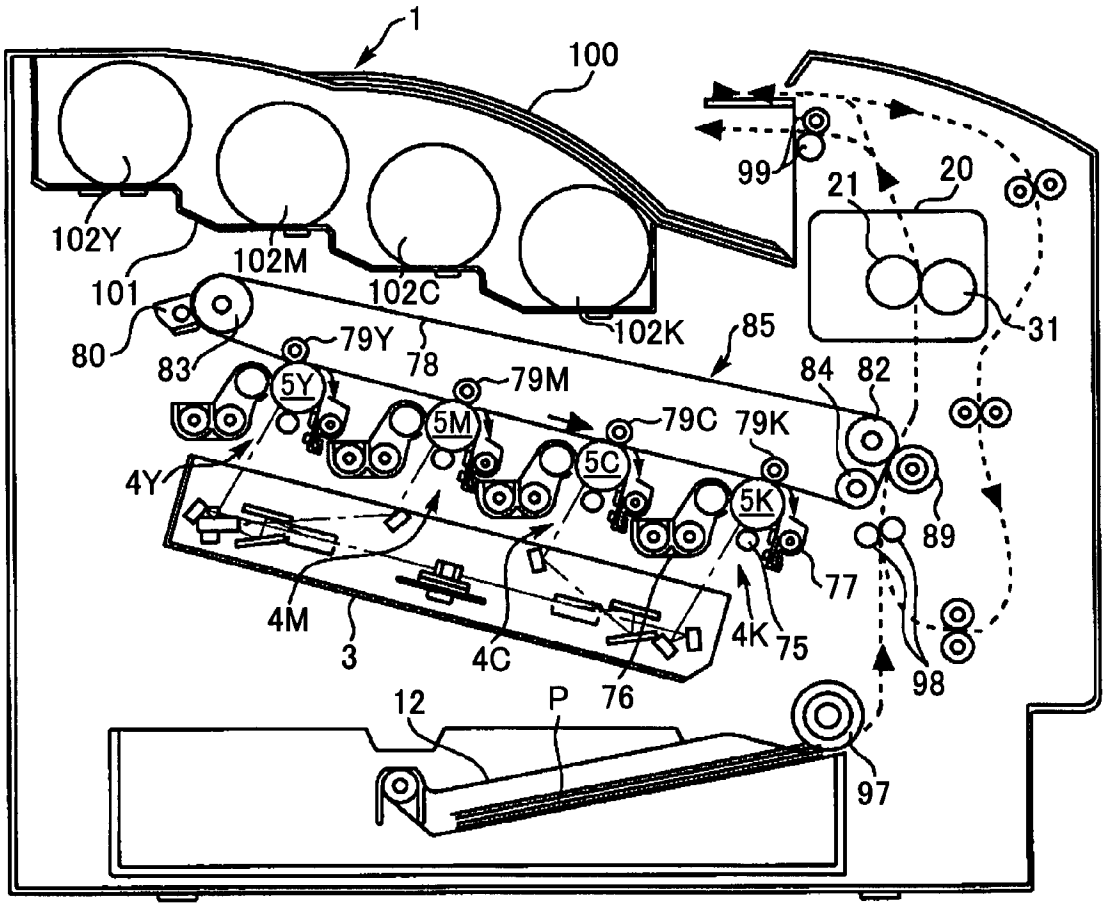
FIG. 1 is a structural view showing an image forming apparatus of a first embodiment of the present invention.

Inventors of the present invention found that, through experiments to solve the above-mentioned problem, further improvement of the heating efficiency of the fixing member and reduction of wear based on sliding contact of the fixing member and the metal member at the time of operation can be achieved by using the following. That is, at the warming-up time, a metal member provided inside a fixing member is deformed to a maximum deformation amount (deformation amount from a normal temperature state) at a time just after heating is started. After that, at a time when a sheet is fed, the temperature of the metal member is entirely substantially equalized so that a stable deformed state with a relatively small deformation amount is maintained.

Based on the above, the embodiments of the present invention may be to provide a fixing device including: a flexible endless fixing member configured to move in a designated direction and heat a toner image so as to melt the toner image; a metal member fixedly provided so as to face an internal circumferential surface of the fixing member with a clearance and configured to heat the fixing member, the metal member being heated by a heating part; and a pressing member configured to press and contact the fixing member so as to form a nip part where a recording medium is conveyed, wherein "A" is equal to or less than "$B_{max}$" and greater than "$B_{ave}$" ("$B_{max}$"≧"A">"$B_{ave}$"), where "A" represents an amount of a clearance at the time of normal temperature between the fixing member and the metal member, "$B_{max}$" represents a maximum amount of deformation generated in the metal member when heating is started by the heating member from a normal temperature state, and "$B_{ave}$" represents an amount of stable deformation generated in the metal member when the temperature of the entire metal member becomes even.

According to the embodiments of the present invention, a clearance amount of the metal member and the fixing member is optimized by using the following characteristics. That is, at the warming-up time when heating starts, a metal member provided inside a fixing member is deformed to a maximum deformation amount. At the time when the sheet is fed, the stable deformed state with a relatively small deformation amount is maintained. As a result of this, the embodiments of the present invention can provide a fixing device and an image forming apparatus whereby a warming-up time or a first printing time is short; bad fixing does not happen even if a process of the apparatus is made to speed up; heating efficiency of the fixing member is sufficiently high; and the likelihood of generating a problem where a fixing member makes sliding contact with a metal member so as to become worn at the time of operation of the image forming apparatus is reduced.

A description is given below, with reference to the FIG. 1 through FIG. 9 of embodiments of the present invention. In drawings, parts that are the same as the parts shown in a drawing referred to previously are given the same reference numerals, and explanation thereof is omitted.

First Embodiment

A first embodiment of the present invention is discussed in detail with reference to FIG. 1 through FIG. 8.

First, the overall configuration and operation of an image forming apparatus is discussed with reference to FIG. 1.

As shown in FIG. 1, an image forming apparatus 1 according to the first embodiment of the present invention is a tandem-type color printer. Four toner bottles 102Y, 102M, 102C, and 102K corresponding to colors yellow, magenta, cyan, and black, respectively, are removably (exchangeably) installed in a bottle housing portion 101 above the image forming apparatus main unit 1.

An intermediate transfer unit 85 is arranged below the bottle housing portion 101. Image forming portions 4Y, 4M, 4C, and 4K corresponding to colors yellow, magenta, cyan, and black are provided in a row arrangement so as to be facing an intermediate transfer belt 78 of the intermediate transfer unit 85.

Photosensitive drums 5Y, 5M, 5C, and 5K are arranged in the image forming portions 4Y, 4M, 4C, and 4K, respectively. Furthermore, a charging portion 75, a developing portion 76, a cleaning portion 77, a charge removing portion (not shown in drawing) and the like are arranged around each of the photosensitive drums 5Y, 5M, 5C, and 5K. Image forming processes (a charging process, an exposing process, a developing process, a transfer process, and a cleaning process) are carried out on each of the photosensitive drums 5Y, 5M, 5C, and 5K such that images of the respective colors are formed on the photosensitive drums 5Y, 5M, 5C, and 5K.

The photosensitive drums 5Y, 5M, 5C, and 5K are rotationally driven by a drive motor not shown in the drawing in a clockwise direction of FIG. 1. Surfaces of the photosensitive drums 5Y, 5M, 5C, and 5K are uniformly charged (charging process) in positions of the charging portions 75.

After that, the surfaces of the photosensitive drums 5Y, 5M, 5C, and 5K reach irradiation positions of laser lights, which are emitted from an exposing portion 3, and electrostatic latent images are formed corresponding to the respective colors by exposure scanning at these positions (exposure process).

Then, the surfaces of the photosensitive drums 5Y, 5M, 5C, and 5K reach positions facing developing devices 76, and the electrostatic latent images are developed at these positions such that corresponding toner images are formed (developing process).

After that, the surfaces of the photosensitive drums 5Y, 5M, 5C, and 5K reach positions where the intermediate transfer belt 78 and corresponding primary transfer bias rollers 79Y, 79M, 79C, and 79K face each other, and the toner images on the photosensitive drums 5Y, 5M, 5C, and 5K are transferred onto the intermediate transfer belt 78 at these positions (primary transfer process). At this time, although miniscule, a small amount of untransferred toner remains on the photosensitive drums 5Y, 5M, 5C, and 5K.

Then, the surfaces of the photosensitive drums 5Y, 5M, 5C, and 5K reach positions facing the cleaning portions 77. The untransferred toner remaining on the photosensitive drums 5Y, 5M, 5C, and 5K is mechanically recovered by cleaning blades of the cleaning portions 77 in these positions (cleaning process).

Finally, the surfaces of the photosensitive drums 5Y, 5M, 5C, and 5K reach positions facing the charge removing portions, which are not shown in the drawing, and residual electric potential on the surfaces of the photosensitive drums 5Y, 5M, 5C, and 5K is removed in these positions.

In this manner, a series of image forming processes, which are carried out on the photosensitive drums 5Y, 5M, 5C, and 5K, is completed.

After this, the color toner images formed on each of the photosensitive drums through the developing process are transferred and superposed onto the intermediate transfer belt 78. In this manner, a color image is formed on the intermediate transfer belt 78.

Here, the intermediate transfer unit 85 is constituted by components such as the intermediate transfer belt 78, the four primary transfer bias rollers 79Y, 79M, 79C, and 79K, a secondary transfer backup roller 82, a cleaning backup roller 83, a tension roller 84, and an intermediate transfer cleaning portion 80. The intermediate transfer belt 78 spans and is supported by the three rollers 82 through 84, and is endlessly moved in a direction shown by an arrow in FIG. 1 by the rotational drive of the single secondary transfer backup roller 82.

The four primary transfer bias rollers 79Y, 79M, 79C, and 79K sandwich the intermediate transfer belt 78 between the photosensitive drums 5Y, 5M, 5C, and 5K, respectively, to form primary transfer nips. A transfer bias that is opposite to the polarity of the toner is applied to the primary transfer bias rollers 79Y, 79M, 79C, and 79K.

Then, the intermediate transfer belt 78 travels in the arrow direction so that it passes in order the primary transfer nips of the primary transfer bias rollers 79Y, 79M, 79C, and 79K. In this manner, the color toner images on the photosensitive drums 5Y, 5M, 5C, and 5K are superposed and undergo primary transfer onto the intermediate transfer belt 78.

After that, the intermediate transfer belt 78, onto which the color toner images have been superposed and transferred, reaches a position facing a secondary transfer roller 89. In this position, the secondary transfer backup roller 82 and the secondary transfer roller 89 sandwich the intermediate transfer belt 78 to form a secondary transfer nip. Then, the toner image of the four colors that has been formed on the intermediate transfer belt 78 is transferred onto a recording medium P that has been transported to the position of the secondary transfer nip. At this time, untransferred toner that has not been transferred to the recording medium P remains on the intermediate transfer belt 78.

After that, the intermediate transfer belt 78 reaches a position of the intermediate transfer cleaning portion 80, and the untransferred toner on the intermediate transfer belt 78 is recovered in this position.

In this manner, a series of transfer processes carried out on the intermediate transfer belt 78 is completed.

Here, the recording medium P that has been transported to the position of the secondary transfer nip is a recording medium that has been transported via rollers such as a paper feeding roller 97 and a pair of registration rollers 98 from a paper feeding portion 12 arranged below the apparatus main unit 1.

More specifically, plural sheets of recording media P such as transfer papers or the like are stacked and accommodated in the paper feeding portion 12. Then, when the paper feeding roller 97 is rotationally driven in a counterclockwise direction of FIG. 1, a topmost recording medium P is supplied between the rollers of the pair of registration rollers 98.

The recording medium P that has been transported to the pair of registration rollers 98 temporarily stops at a roller nip position of the pair of registration rollers 98, whose rotational drive has been stopped. Then, the pair of registration rollers 98 is rotationally driven matched to a timing of the color image on the intermediate transfer belt 78 such that the recording medium P is transported to the secondary transfer nip. In this manner, the desired color image is transferred onto the recording medium P.

After that, the recording medium P onto which the color image has been transferred in the position of the secondary transfer nip is transported to the nip portion of a fixing device 20 (a position where a fixing roller 21 and a pressing roller 31 press against each other). Then, due to the heat and pressure of the fixing roller 21 and the pressing roller 31 in the nip portion (fixing nip portion), the color image that has been transferred to the surface of the recording medium P is fixed onto the recording medium P.

Then, the recording medium P is discharged outside the apparatus by traveling between the rollers of a pair of discharge rollers 99. The recording media P that have been discharged outside the apparatus by the pair of discharge rollers 99 are stacked in order on a stack portion 100 as an output image.

In this manner, a series of image forming processes is completed in the image forming apparatus.

Next, a detailed description is given with reference to FIG. 2 through FIG. 5 regarding a configuration and operation of the fixing device 20 that is installed in the image forming apparatus main unit 1.

Figure 2:
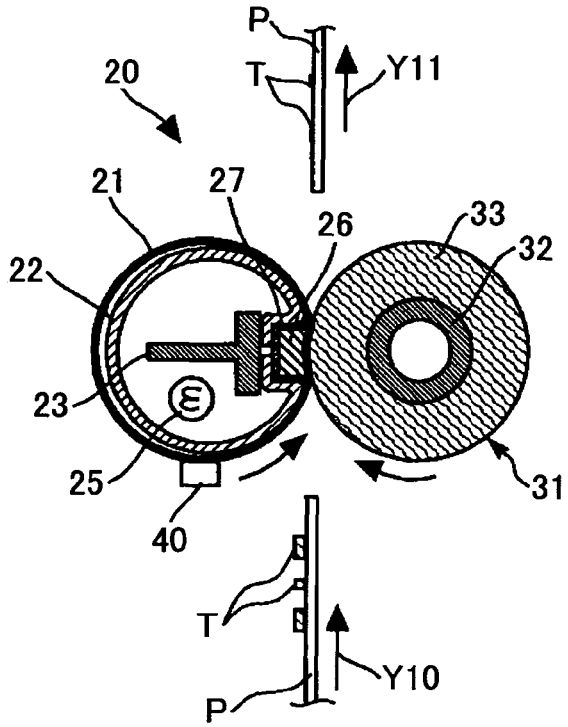
FIG. 2 is a structural view showing a fixing device provided in the image forming apparatus shown in FIG. 1.
Figure 3:
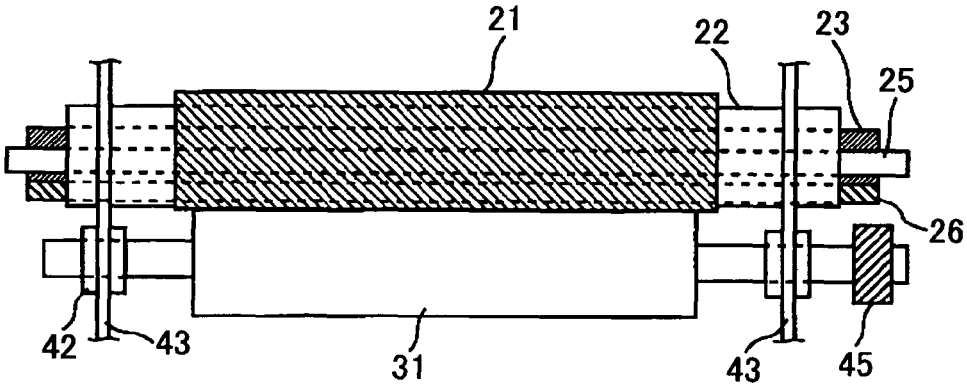
FIG. 3 is a view seen in a width direction of the fixing device shown in FIG. 2.
Figure 4:
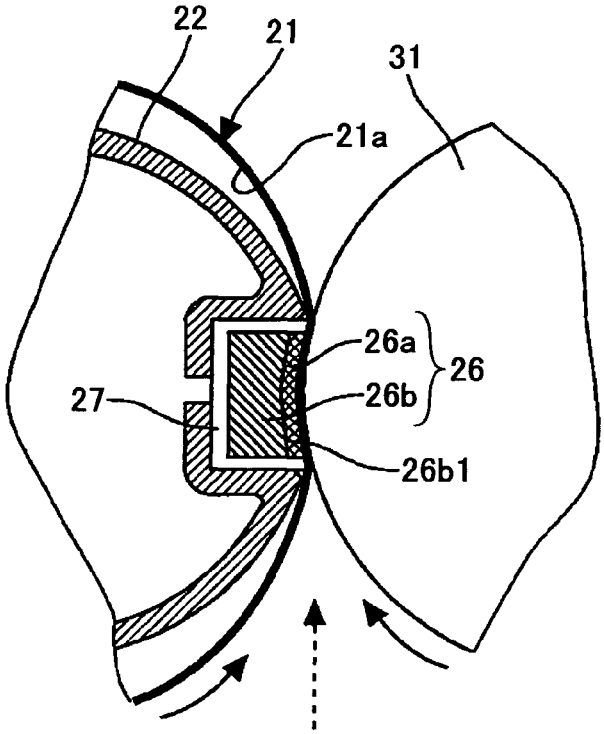
FIG. 4 is an expanded view showing a vicinity of a nip part.
Figure 5:
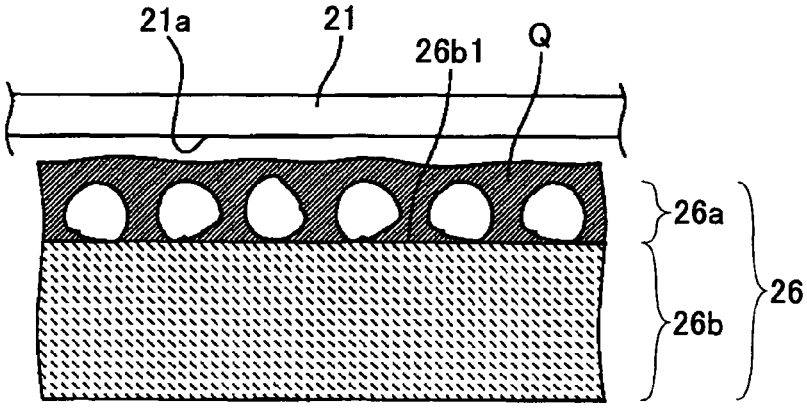
FIG. 5 is an expanded view of a sliding contact part of a fixing belt and a fixing member.

Here, FIG. 2 is a structural view showing the fixing device 20 provided in the image forming apparatus shown in FIG. 1. FIG. 3 is a view seen in a width direction of the fixing device 20 shown in FIG. 2. FIG. 4 is an expanded view showing a vicinity of a nip part of the fixing device 20. FIG. 5 is an expanded view of a sliding contact part of a fixing belt 21 and a fixating member 26.

As shown in FIG. 2, the fixing device 20 includes the fixing roller (belt member) 21 as a fixing member, a fixating member 26, a metal member 22 as a heating member, a reinforcing member 23, an adiabatic member 27, a heater (heat source) 25 as a heating member, the pressing roller 31 as a pressing member, and a temperature sensor 40.

Here, the fixing belt 21 as a fixing member is a thin endless belt having flexibility. The fixing belt 21 is rotated (runs) in a direction indicated by an arrow, namely a counterclockwise direction, in FIG. 2. The fixing belt 21 is formed by stacking, from an internal circumferential surface (the surface being in sliding contact with the fixating member 26), a surface layer, a base layer, an elastic layer, and a release layer. The thickness of the entire fixing belt 21 is equal to or less than 1 mm.

The surface layer 21*a* (internal circumferential surface) of the fixing belt 21 has a film thickness equal to or less than 50 μm and is made of a material including fluorine. More specifically, a fluoric resin material, such as PFA (tetrafluoroethylene-perfluoroalkyl vinyl ether copolymer), PTFE (polytetrafluoroethylene), or FEP (tetrafluoroethylene-hexa fluoropropylene copolymer), or a material formed by mixing resin, such as polyimide, polyamide, or polyamide-imide, into the fluoric resin material can be used as a material forming the surface layer 21*a* (sliding layer). Details of the surface layer 21*a* of the fixing belt 21 are discussed below.

The base layer of the fixing belt 21 has a film thickness of approximately 30 μm through approximately 50 μm. The base layer of the fixing belt 21 is made of a metal material such as nickel or stainless or a resin material such as polyimide.

The elastic layer of the fixing belt 21 has a film thickness of approximately 100 μm through approximately 300 μm. The elastic layer of the fixing belt 21 is made of a rubber material such as silicone rubber, expandable silicone rubber, or fluororubber. By providing the elastic layer, minute concavities and convexities are not formed on a surface of the fixing belt 21 at the nip part so that heat is evenly transferred to the toner image on the recording medium so that generation of an orange-peel surface is prevented.

The release layer of the fixing belt 21 has a film thickness of approximately 10 μm through approximately 50 μm. The release layer of the fixing belt 21 is made of a material such as PFA, PTFE, polyimide, polyetherimide, or PES (polyethersulfide). By providing the release film, it is possible to secure the releasing ability (pealing ability) relative to a toner T (toner image).

In addition, a diameter of the fixing belt 21 is approximately 15 mm through approximately 120 mm. In the first embodiment of the present invention, an internal diameter at a normal temperature is approximately 30 mm.

The fixating member 26, the heater 25 as a heating part, the metal member 22, the reinforcing member 23, the adiabatic member 27, and others are fixed inside (at an internal circumferential surface side of) the fixing belt 21.

Here, the fixating member 26 is fixed to touch the internal circumferential surface of the fixing belt 21 so as to make sliding contact with the internal circumferential surface of the fixing belt 21 via a lubricant such as fluoro grease. The fixating member 26 is pressed and comes in contact with the pressing roller 31 via the fixing belt 21 to form a nip part where the recording, medium P is conveyed. As shown in FIG. 3, both end parts of the fixating member 26 in a width direction of the fixating member 26 are fixed to and supported by side plates 43 of the fixing device 20. A structure and an operation of the fixating member 26 are discussed in detail below.

As shown in FIG. 2, the metal member 22 has a substantially cylindrical-shaped configuration. The metal member 22 as a heating member is formed in positions along the fixing belt 21 except the nip part so as to face the internal circumferential surface of the fixing belt 21. In a position of the nip part of the fixing belt 21, the metal member 22 is formed so as to support the fixating member 26 via the adiabatic member 27. As shown in FIG. 3, both end parts of the metal member 22 in a width direction of the metal member 22 are fixed to and supported by the side plates 43 of the fixing device 20.

In addition, the metal member 22 is heated by radiation heat of the heater 25 so as to heat the fixing belt 21 (transfer the heat to the fixing belt 21). In other words, the metal member 22 is directly heated by the heater 25 as a heating member and the fixing belt 21 is indirectly heated by the heater 25 as a heating member via the metal member 22. In order to maintain high heating efficiency of the fixing belt 21, it is preferable that the metal member 22 have a thickness equal to or less than 0.1 mm.

A metal heat conductive body such as stainless steel, nickel, aluminum, or iron, namely metal having heat conductivity, can be used as a material of the metal member 22. It is preferable to use ferritic stainless steel having a relatively low heat capacity ratio per unit volume (density×specific heat) as the material of the metal member 22. In the first embodiment of the present invention, SUS 430 which is ferritic stainless steel is used as the material of the metal member 22. In addition, in the first embodiment of the present invention, the metal member 22 has a thickness of approximately 0.1 mm and an external diameter at a normal temperature of approximately 29.5 mm.

The relationship between the metal member 22 and the fixing belt 21 is discussed in detail below.

The heater (heat source) 25 as the heating part is, for example, a halogen heater or a carbon heater. Both end parts of the heater 25 are fixed to the side plates 43 of the fixing device 20. See FIG. 3. The metal member 22 is heated by the radiation heat of the heater 25 whose output is controlled by an electric source part of the apparatus main unit 1. In addition, the fixing belt 21 is entirely heated, by the metal member 22, in positions except the nip part so that heat is applied to the toner image T on the recording medium P from a heated surface of the fixing belt 21. The output control of the heater 25 is performed based on the result of detection of the temperature of the fixing belt 21 surface by a temperature sensor 40 such as a thermistor facing the surface of the fixing belt 21. In addition, by the output control of the heater 25, the temperature of the fixing belt 21 (fixing temperature) can be set to be a desirable temperature.

Thus, in the fixing device 20 of the first embodiment of the present invention, only a part of the fixing belt 21 is not heated. Substantially the entirety of the fixing belt 21 is heated by the metal member 22 in a circumferential direction. Accordingly, even if processes of the apparatus are made to speed up, the fixing belt 21 is sufficiently heated so that bad fixing can be restrained. In other words, since the fixing belt 21 can be heated efficiently with a relatively simple structure, a warming-up time or a first printing time can be made short and the apparatus can be downsized.

Here, the metal member 22 is fixed so as to face the internal circumferential surface of the fixing belt 21 (except the nip part) with clearance. It is preferable that an amount A of the clearance between the fixing belt 21 and the metal member 22 (a gap in positions except the nip part) be larger than 0 mm and equal to or less than 1 mm ($0\ \text{mm} < A \leqq 1\ \text{mm}$). Because of this, an area where the metal member 22 and the fixing belt 21 make sliding contact with each other is small so that increase of friction of the fixing belt 21 can be restrained. In addition, degradation of the heating efficiency due to excessive separation between the metal member 22 and the fixing belt 21 can be restrained. Furthermore, by providing the metal member 22 in the vicinity of the fixing belt 21, a circular-shaped configuration of the fixing belt 21 having flexibility can be maintained to a certain degree. Hence, degradation or damage of the fixing belt 21 due to deformation of the fixing belt 21 can be reduced.

In order to reduce the friction of the fixing belt 21 even if the metal member 22 and the fixing belt 21 make sliding contact with each other, a surface layer made of a material including fluorine is formed on an internal circumferential surface of the fixing belt 21 and the lubricant such as fluoro grease is applied between the members 21 and 22. In addition, a sliding contact surface of the metal member 22 can be made of a material having a low coefficient of friction. Although the metal member 22 has a substantially circular-shaped cross-sectional configuration in the first embodiment of the present invention, the present invention is not limited to this. The cross section of the metal member 22 may be polygonal-shaped, and a slit may be formed in a circumferential surface of the metal member 22.

Here, in the first embodiment of the present invention, the reinforcing member 23 is fixed within the internal circumferential side of the fixing belt 21. The reinforcing member 23 is configured to reinforce the strength of the fixating member 26 forming the nip part. As shown in FIG. 3, a length of the reinforcing member 23 in a width direction of the reinforcing member 23 is substantially equal to that of the fixating member 26. Both end parts of the reinforcing member 23 in the width direction of the reinforcing member 23 are fixed to and supported by the support plates 43. By the reinforcing member 23 making contact with the pressing roller 31 via the fixating member 26 and the fixing belt 21, a problem where the fixating member 26 receives a pressing force of the pressing roller 31 at the nip part so as to be deformed a lot can be prevented.

In order to satisfy the above-mentioned functions, it is preferable that the reinforcing member 23 be made of a metal material having high mechanical strength such as stainless or iron. An adiabatic member may be provided on or a mirror surface process may be applied to a part or an entirety of a surface of the reinforcing member 23 facing the heater 25. As a result of this, heat from the heater 25 radiated toward the reinforcing member 23 (heat heating the reinforcing member 23) is not used for heating the metal member 22. Hence, the heating efficiency of the fixing belt 21 (metal member 22) is further improved.

As shown in FIG. 2, the pressing roller 31 is a pressing member configured to come in contact with the external circumferential surface of the fixing belt 21 in a position of the nip part. A diameter of the pressing roller 31 is approximately 30 mm. The pressing roller 31 is made by forming an elastic layer 33 on a cored bar 32 having a hollow structure. The elastic layer 33 of the pressing roller (pressing member) 31 is made of a material such as expandable silicone rubber, silicone rubber, or fluororubber. A thin release layer made of, for example, PFA (tetrafluoroethylene-perfluoroalkyl vinyl ether copolymer), or PTFE (polytetrafluoroethylene) may be provided on the surface layer of the elastic layer 33. The pressing roller 31 presses and makes contact with the fixing belt 21 so that a desirable nip part is provided between the pressing roller 31 and the fixing belt 21. As shown in FIG. 3, a gear 45 is provided at the pressing roller 31. The gear 45 is meshed with a driving gear of a driving mechanism (not shown in FIG. 3). The pressing roller 31 is rotated in an arrow direction in FIG. 2, namely a clockwise direction. In addition, both end parts of the pressing roller 31 in a width direction of the pressing roller 31 are rotatably supported at the side plates 43 via bearings 42. A heat source such as a halogen heater may be provided inside the pressing roller 31.

In a case where the elastic layer 33 of the pressing roller 31 is made of a sponge material such as expandable silicone rubber, since a pressing forced applied to the nip part can be reduced, bending generated at the metal member 22 can be further reduced. In addition, since the adiabatic characteristic of the pressing roller 31 can be improved so that the heat of the fixing belt 21 may not be transferred to a pressing roller 31 side, the heating efficiency of the fixing belt 21 is improved.

In addition, in the first embodiment of the present invention, the diameter of the fixing belt 21 is substantially equal to a diameter of the pressing roller 31. However, the present invention is not limited to this. The diameter of the fixing belt 21 may be formed so as to be smaller than the diameter of the pressing roller 31. In this case, since a curvature of the fixing belt 21 at the nip part is smaller than a curvature of the pressing roller 31, the recording medium P sent from the nip part may be easily separated from the fixing belt 21.

Referring to FIG. 4, in the fixating member 26 which makes sliding contact with the internal circumferential surface 21*a* of the fixing belt 21, a surface layer 26*a* is formed on a base later 26*b*. A sliding contact surface of the fixating member 26 facing the pressing roller 31 has a concave configuration so that the curvature of the slide contact surface of, the fixating member 26 is consistent with the curvature of the pressing roller 31. With this structure, since the recording medium P is sent from the nip part so that the curvature of the recording medium P is consistent with the curvature of the pressing roller 31, it is possible to prevent a problem where the recording medium P after the fixing process is adhered to and not separated from the fixing belt 21.

In the first embodiment of the present invention, the fixating member 26 forming the nip part has a concave-shaped configuration. However, the fixating member 26 forming the nip part may have a plane surface-shaped configuration. In other words, a sliding contact surface of the fixating member 26, namely a surface facing the pressing roller 31, may be a plane surface-shaped configuration. In this case, the configuration of the nip part is substantially parallel with an image surface of the recording medium P so that the adhesion of the fixing belt 21 and the recording medium P is improved and fixing capabilities are improved. Furthermore, since the curvature of the fixing belt 21 at an exit side of the nip part is large, it is possible to easily separate the recording medium P sent from the nip part from the fixing belt 21.

In addition, the base layer 26*b* of the fixating member 26 is made of a material having a certain degree of rigidity (for example, ceramic or metal having a high rigidity) so that the base layer 26*b* is not greatly bent even if a pressing force from the pressing roller 31 is applied.

The metal member 22 having a substantially pipe-shaped configuration is formed by bending a metal plate and therefore the metal member 22 can be made thin so that the warming-up time can be shortened. However, since the rigidity of the metal member 22 itself is low, the metal member 22 cannot resist the pressing force of the pressing roller 31 and may be bent or deformed. If the pipe-shaped metal member 22 is deformed, a desirable nip width cannot be obtained so that the fixing capabilities may be degraded. On the other hand, in the first embodiment of the present invention, the fixating member 26 having high rigidity is provided separately from the thin metal member 22 so that the nip part is formed, and the above-mentioned problem can be prevented.

In the meantime, in the first embodiment of the present invention, the adiabatic member 27 is provided between the fixating member 26 and the heater (heating part) 25. More specifically, the adiabatic member 27 is provided between the fixating member 26 and the metal member 22 so as to cover a surface of the fixating member 26 except the slide contact surface of the fixating member 26. Sponge rubber having a high adiabatic characteristic, a ceramic being almost adiabatic, or the like can be used as a material of the adiabatic member 27.

In the first embodiment of the present invention, the fixing belt 21 and the metal member 22 come close to each other at substantially the entire circumferences of the fixing belt 21 and the metal member 22. Accordingly, even at a heat stand-by time (printing operation stand-by time), it, is possible to heat the fixing belt 21 in a circumferential direction without temperature unevenness. Accordingly, after receiving the printing instructions, the apparatus can immediately perform the printing operation. In a case of a related art on-demand type fixing device (see, for example Japanese Patent 2884714), if heat is applied to the nip part at the heat stand-by time while the pressing roller is deformed, depending on a rubber material of the pressing roller, the service life time of the pressing roller may be shortened due to heat degradation or permanent compression set may be generated at the pressing roller. The permanent compression set of rubber is increased based on application of the heat to deform the rubber. When the permanent compression set is generated at the pressing roller, a part of the pressing roller becomes hollow so that a desirable nip width cannot be obtained, bad fixing is generated and allophone is generated at the time of rotation.

On the other hand, in the first embodiment of the present invention, since the adiabatic member 27 is provided between the fixating member 26 and the metal member 22, heat of the metal member 22 may not be transferred to the fixating member 26 at the time of heat stand-by time. Accordingly, a deficiency when high temperature heating is applied at the heat stand-by time where the pressing roller 31 is deformed is reduced so that generation of the above-mentioned problem can be prevented.

The lubricant applied between the fixating member 26 and the fixing belt 21 and configured to reduce the friction resistance between the fixating member 26 and the fixing belt 21 may be degraded due to use at the high temperature conditions in addition to the high pressure conditions at the nip part. As a result of this, a deficiency such as slipping of the fixing belt 21 may be generated.

On the other hand, in the first embodiment of the present invention, since the adiabatic member 27 is provided between the fixating member 26 and the metal member 22, heat of the metal member 22 may not be transferred to the lubricant situated at the nip part. Therefore, degradation of the lubricant due to high temperature is reduced so that generation of the above-mentioned problems can be prevented.

Furthermore, in the first embodiment of the present invention, since the adiabatic member 27 is provided between the fixating member 26 and the metal member 22, the fixating member 26 is thermally insulated and the fixing belt 21 is not actively heated at the nip part. Because of this, the temperature of the recording medium P becomes low when the recording medium P being sent to the nip part is sent out from the nip part. In other words, the temperature of the toner image adhered on the recording medium P becomes low at a nip part exit so that viscosity of the toner is decreased. Where the toner adhesive force relative to the fixing belt 21 is small, the recording medium P is separated from the fixing belt 21. Therefore, it is possible to prevent a deficiency where the recording medium P just after the fixing process is wound around the fixing belt 21 so that a jam is generated. In addition, the adhesion of toner to the fixing belt 21 can be restrained.

In the first embodiment of the present invention, both the fixating member 26 and the fixing belt 21 (belt member) include surface layers made of a material including fluorine and provided on the sliding contact surfaces where the fixating member 26 and the fixing belt 21 make contact. In other words, as shown in FIG. 4, the surface layer made of a fluoro material is formed as the sliding contact surface 26*a* of the fixating member 26. Additionally, the surface layer made of a fluoro material is formed on the sliding contact surface 21*a* of the fixing belt 21. One of the surface layers 21*a* and 26*a* of the members 21 and 26 (the surface layer 26*a* of the fixating member 26 in the first embodiment of the present invention) is formed in a porous state. In addition, one of the surface layers 21*a* and 26*a* of the members 21 and 26 (the surface layer 21*a* of the fixing belt 21 in the first embodiment of the present invention) has surface energy greater than an interfacial force of the lubricant.

With this structure, durability of the lubricant held on the sliding contact surface of the members 21 and 26 is extremely improved so that the friction between the fixing belt 21 and the fixating member 26 is extremely decreased.

Detailed structures of the fixing belt 21 and the fixating member 26 of the first embodiment of the present invention are discussed below.

The surface layer (sliding contact layer) 21*a* of the fixing belt 21 has a film thickness equal to or less than 50 μm and is made of a material including fluorine. In addition, the surface energy of the surface layer 21*a* is greater than the interfacial force of the lubricant. More specifically, as a material forming the surface layer (slide contact layer) 21*a* of the fixing belt 21, a mixture is used where resin such as polyimide, polyamide, or polyamide-imide is mixed into a fluoric resin material, such as PFA (tetrafluoroethylene-perfluoroalkyl vinyl ether copolymer), PTFE (polytetrafluoroethylene), or (tetrafluoroethylene-hexa fluoropropylene copolymer).

The surface layer 26*a* of the fixating member 26 is formed by fluoro coating (such as a coating material where fluorine particles as solid lubricant are diffused or eutectoid plating where fluorine molecules are diffused), fluorine resin (PFA, PTFE, FEP, or the like), a fluorine resin film, or the like. A blast process or an etching process is applied so that a porous state surface layer 26*a* is formed. In addition, a sheet where a fluoro coating is applied to a surface of glass cloth, mesh where fibers of fluorine resin are woven, or the like can be used as the surface layer 26*a* of the fixating member 26. The definition of the "porous state" surface layer 26*a* in the present application includes not only a surface layer where a large number of holes pierce from a front surface of the surface layer 26*a* to a rear surface of the surface layer 26*a* but also a surface layer where a large number of concavities and convexities (holes not piercing through the rear surface) are formed in the front surface (slide contact surface) of the surface layer 26*a*.

Fluoro grease or the like can be used as the lubricant provided between the fixing belt 21 and the fixating member 26.

With this structure, comparing a case where one of the surface layers is made of the fluoro material and another of the surface layers is made of the polyimide resin, friction resistance of the sliding contact surfaces is extremely low. Therefore, durability of the fixing belt 21 and the fixating member 26 is improved. In other words, in a case where a rigid surface layer makes sliding contact with the surface layer made of a relatively soft fluoro material, the surface layer made of the soft fluoro material is greatly worn. However, in the first embodiment of the present invention, since both surface layers are made of the relatively soft fluoro material, neither surface layer is drastically worn. In addition, by forming either surface layer in the porous state, a contact area of the surface layers is decreased so that the friction resistance of the surface layers is reduced.

In addition, if both the surface layers are formed to smoothly contact each other, since the surface energy of the surface layer formed of the fluoro material (wetability relative to the lubricant) is low, the lubricant is repelled so that sliding capabilities are degraded. On the other hand, in the first embodiment of the present invention, since one of the surface layers is formed in the porous state, the lubricant is held in holes of the surface layer even if time passes. In other words, as shown in FIG. 5, as viewed through a microscope, lubricant Q enters into meshes of the surface layer 26*a* formed in the porous manner (a structure where a large number of gaps are formed between white circles as shown in FIG. 5), so that the lubricant Q is securely held by the surface layer 26*a*. With this structure, low friction ability and low abrasion ability between the fixing belt 21 and the fixating member 26 are improved and holding ability of the lubricant of the slide contact surfaces is improved. Hence, durability of the fixing device 20 is drastically improved.

Next, operations of the fixing device 20 having the above-discussed structure are briefly discussed.

When an electric power switch of the apparatus main unit 1 is turned on, electric power is supplied to the heater 25 and the pressing roller 31 is rotated in an arrow direction shown in FIG. 2. As a result of this, the fixing belt 21 is also rotated in the arrow direction shown in FIG. 2 due to friction force with the pressing roller 31.

After that, the recording medium P is fed by the sheet feeding part 12 while a non-fixed color image is carried (transferred) on the recording medium P in a position of the secondary transfer roller 89. The recording medium P where the non-fixed color image T (toner image) is carried is guided by a guide plate (not shown) and conveyed in an arrow Y10 direction shown in FIG. 2. The recording medium P is transferred to the nip part of the pressing roller 31 and the fixing belt 21 in a pressed state.

The toner image T is fixed on the surface of the recording medium P by heat of the fixing belt 21 heated by the metal member 22 (heater 25) and a pressing force of the pressing roller 31 and the fixating member 26 reinforced by the reinforcing member 23. After that, the recording medium P sent out from the nip part is conveyed in a direction indicated by an arrow Y11.

Next, structures and operations of the metal member 22 and the fixing belt 21 of the fixing device 20 of the first embodiment of the present invention are discussed in detail.

Figure 6:
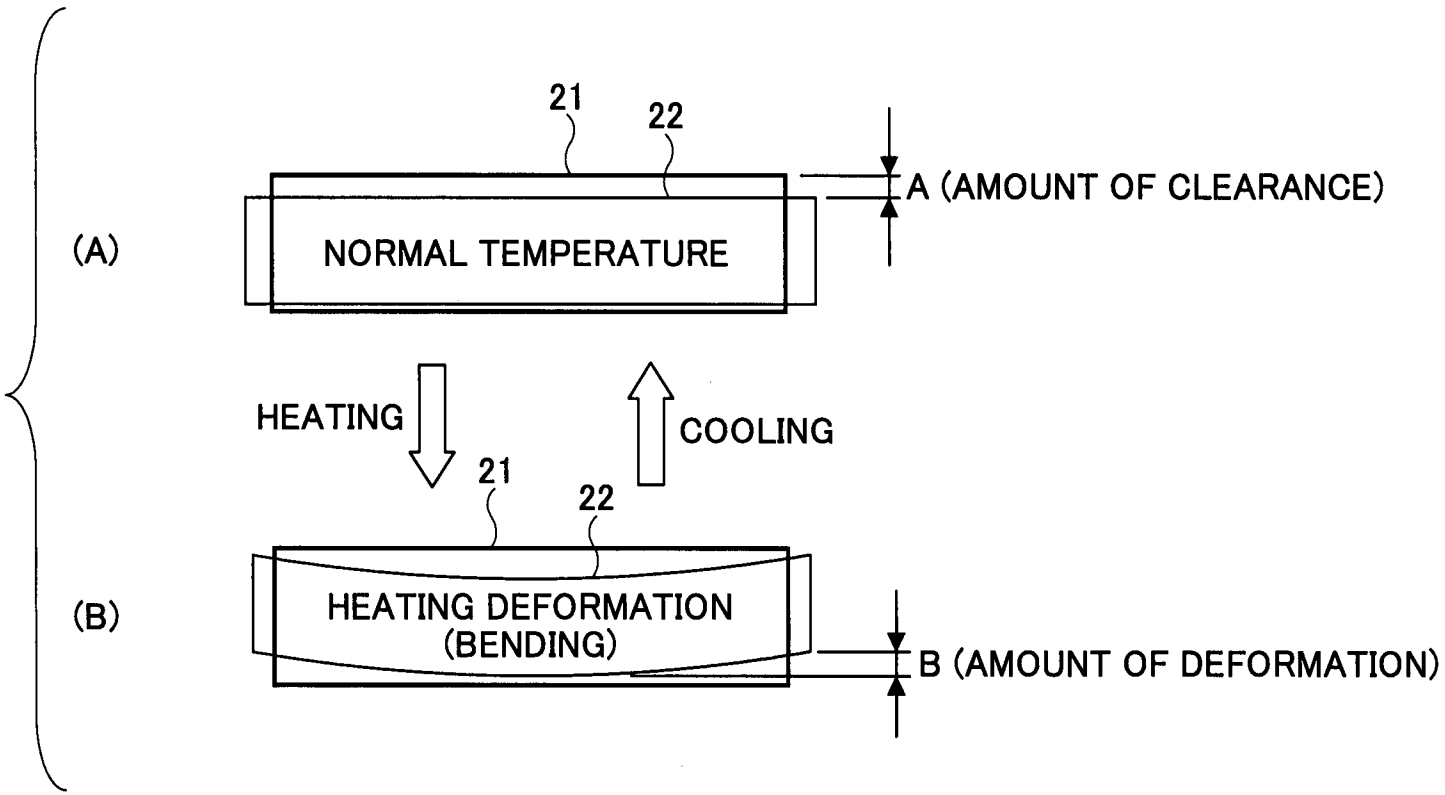
FIG. 6 is a schematic view showing states of heating deformation of the metal member.

FIG. 6 is a view seen from a width direction (corresponding to an illustrating direction of FIG. 3) of the metal member 22 and the fixing belt 21 and a schematic view showing states of heating deformation of the metal member 22. As shown in FIG. 6(A) and FIG. 6(B), the metal member 22 is heated from the normal temperature state so that heating deformation of the metal member 22 is generated and the metal member 22 is bent. Accordingly, the amount A of clearance provided, at the normal temperature, between the metal member 22 and the fixing belt 21, is reduced after the heating time corresponding to the amount B of deformation of the metal member 22. In a normal case where heating and cooling are performed in condition where changes are reversible, when the metal member 22 in the heating deformation state is cooled so as to be at the normal temperature, the amount A of clearance returns to the amount of clearance at the normal temperature state.

Here, the amount A of clearance at the normal temperature between the metal member 22 and the fixing belt 21 is, as shown in FIG. 6(A), the difference, at the normal temperature, between an external diameter of the metal member 22 and an internal diameter of the fixing belt 21 (a minimum value if there is partial difference). In addition, the amount B of deformation of the metal member B is, as shown in FIG. 6(B), a bending amount in a diameter direction from the normal temperature state.

Here, change of the amount B of deformation generated at the metal member 22 when the metal member 22 is heated by the heater 22 from the normal temperature state (a case where a state shown in FIG. 6(A) is changed to a state shown in FIG. 6(B)) is as follows.

First, at the time of warming up or the like, the metal member 22 in the normal temperature state (or close to the normal temperature state) starts being heated by the heater (heating part) 25. This is relatively drastic heating whereby the temperature of the fixing belt 21 is increased to a target fixing temperature (approximately 140° C. through approximately 180° C.). Therefore, the entire temperature distribution of the metal member 22 starts to be uneven just after the heating starts. More specifically, in the metal member 22, the temperature at the external circumferential side which is far from the heater 25 is lower than the temperature at the internal circumferential side which is near to the heater 25 and therefore a relatively large temperature inclination (gradient) is generated in a thickness direction. Because of this, differences of thermal expansion are partially generated in the metal member 22 so that bending due to heating deformation (heating deformation) occurs in the metal member 22. A maximum amount of deformation generated in the metal member 22 is defined as $B_{max}$. However, after that, when preparation for sheet feeding (fixing process) is completed so that the fixing temperature of the fixing belt 21 reaches the vicinity of the target value and becomes stable, the entire temperature distribution of the metal member 22 becomes even (the temperature inclination in the thickness direction becomes small) so that the amount B of deformation of the metal member 22 becomes small so that the stable amount of deformation $B_{ave}$ is maintained.

In the first embodiment, "A" is equal to or less than "$B_{max}$" and greater than "$B_{ave}$" ("$B_{max}$"≧"A">"$B_{ave}$"), where "A" represents an amount of a clearance at the time of normal temperature between the fixing belt 21 and the metal member 22, "$B_{max}$" represents a maximum amount of deformation generated in the metal member 22 when heating is started by the heater 25 from a normal temperature state, and "$B_{ave}$" represents an amount of stable deformation generated in the metal member 22 when the temperature of the entire metal member 22 becomes even. More specifically, in order satisfy the above-mentioned relationship, the internal diameter of the fixing belt 21 and the external diameter of the metal member 22 (the amount A of the clearance), the material or thickness of the metal member 22, fixing conditions such as the fixing temperature, the kind of the heating member, and the like are determined.

In the first embodiment of the present invention, the internal diameter of the fixing belt 21 is approximately 30 mm, the external diameter of the metal member 22 is approximately 29.5 mm, and the amount A of the clearance is approximately 0.5 mm (=30 mm−29.5 mm). As the material of the metal member 22, SUS430 having a thickness of approximately 0.1 mm is used. By using the heater 25 as the heating member, a target fixing temperature (target value in terms of control) is approximately 180° C. Under these conditions, the maximum amount $B_{max}$ of deformation generated in the metal member 22 is approximately 1.3 mm and the amount $B_{ave}$ of stable deformation is approximately 0.4 mm. Thus, the above-mentioned conditions are satisfied.

By setting as above, because of the relationship between the amount A of the clearance and the maximum amount $B_{max}$ of deformation ($B_{max}$≧A), at the time of warming up when the fixing belt 21 stands still, the metal member 22 comes in strong contact with the internal circumferential surface of the fixing belt 21. Heat is conducted from the metal member 22 to the fixing belt 21, not via the air. Hence, the heating efficiency of the fixing belt 21 is improved. More specifically, it is possible to reduce a time for increasing the temperature of the fixing belt 21, comparing to a case where the warming up is performed where the metal member 22 is separated from the fixing belt 21.

In addition, because of the relationship between the amount A of the clearance and the amount $B_{ave}$ of stable deformation (A>$B_{ave}$), at the time of paper feeding (fixing process time) when the fixing belt 21 runs, the metal member 22 faces the internal circumference surface of the fixing belt 21 (or comes in contact with the internal circumference surface of the fixing belt 21 with an extremely weak force). Hence, the fixing belt 21 can be efficiently heated while abrasion of the fixing belt 21 and the metal member 22 is reduced.

Inventors of the present invention found the following via experiments.

Figure 7:
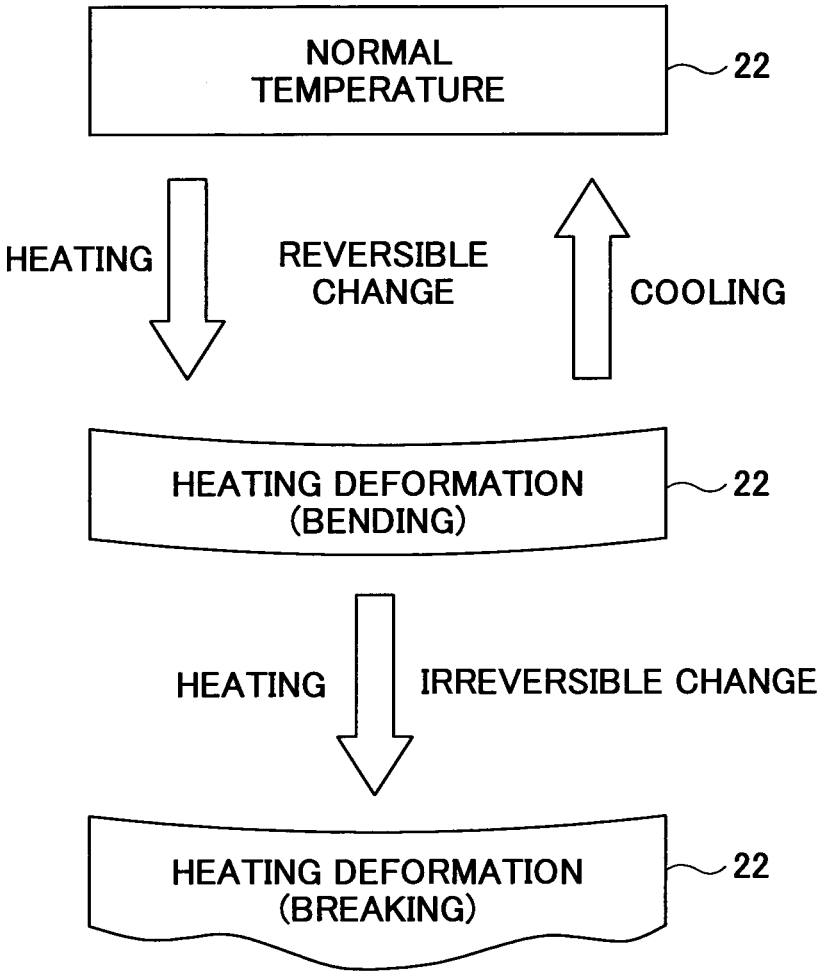
FIG. 7 is a schematic view showing reversible change and irreversible change generated at the time when the metal member is heated.

When the thickness of the metal member 22 is set to be equal to or less than approximately 0.1 mm in order to improve the heating efficiency (reduce heat capacity) of the metal member 22, heating deformation due to irreversible change may be generated in most of materials of the metal member 22. As shown in FIG. 7, the heating deformation based on the irreversible change is different from that of the reversible change where bending (the amount B of deformation) of the metal member 22 generated at the heating time becomes as it was at the time of the normal temperature before heating even if heating and cooling are repeated. The heating deformation based on the irreversible change is a breaking phenomenon where the bending of the metal member generated at the heating time does not become as it was at the time of the normal temperature before heating but remains as plastic deformation even if heating and cooling are repeated. Thus, when the bending phenomenon is generated in the metal member 22, the metal member 22 partially and strongly comes in contact with the internal circumferential surface of the fixing belt 21 at the sheet feeding time, so that the internal circumferential surface of the fixing belt 21 may be scraped or unevenness may be generated in the surface temperature of the fixing belt 21 and thereby bad fixing or uneven glossiness may be generated in the output image.

The inventors of the present invention found that it is effective to optimize the hardness of the metal member 22 in order to prevent the heating deformation (bending phenomenon) due to the irreversible change of the metal member 22. More specifically, if the hardness of the metal member 22 is too high, the metal member 22 cannot resist heat deformation so that the bending phenomenon is generated. On the other hand, if the hardness of the metal member 22 is too low, even if heat deformation of the metal member 22 occurs, since the metal member may be elastically restored, the heat deformation is reversible.

Figure 8:
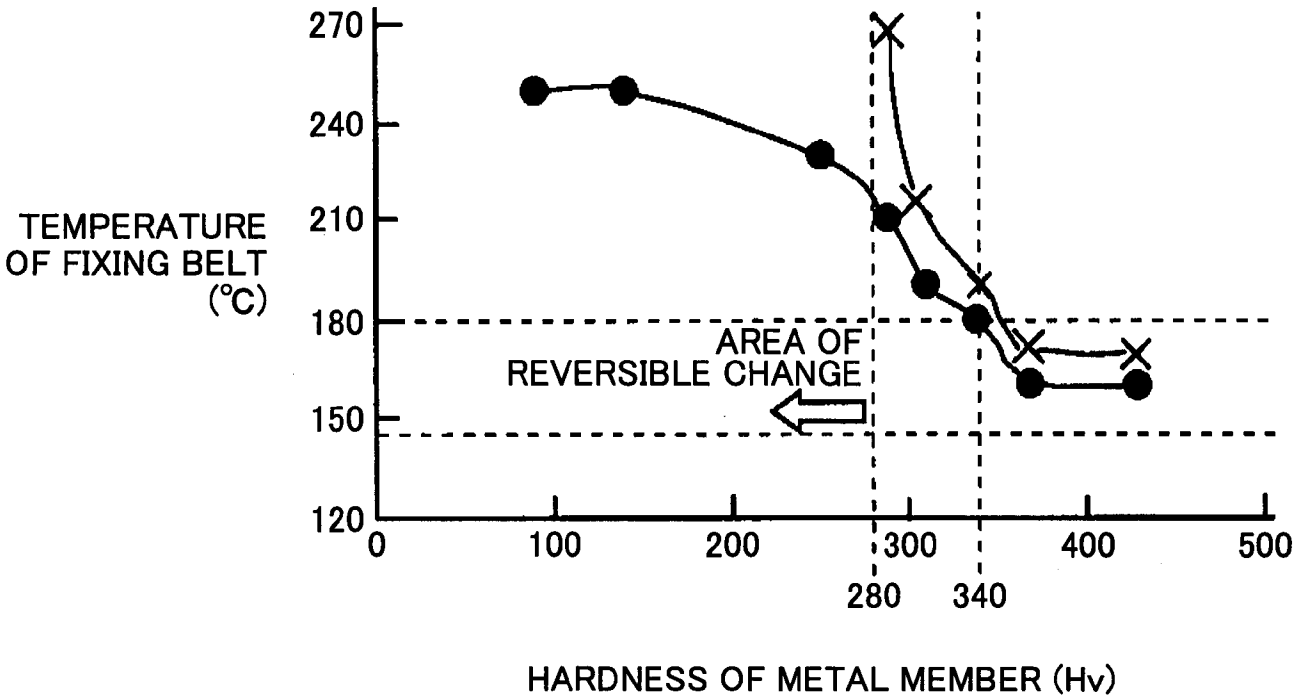
FIG. 8 is a graph showing relationships between Vickers hardness of the metal member and a temperature at which a bending phenomenon happens to the metal member.

FIG. 8 is a graph (experimental results) showing relationships between Vickers hardness (Hv) of the metal member 22 and a temperature at which the metal member 22 bends.

In this experiment, several experimental pieces were manufactured and whether the bending phenomenon is generated when the metal members were drastically heated to the designated temperature was determined. The experimental pieces were made by adhering fixing belts (where a nickel layer having the film thickness of approximately 35 μm, a silicon rubber layer having the film thickness of approximately 20 μm, and a PFA layer having the film thickness of approximately 15 μm are stacked from the metal member side in order) to a surface of the various metal members (each of them having thickness of approximately 0.1 mm) having different Vickers hardness.

In the graph shown in FIG. 8, the horizontal axis shows the Vickers hardness of the metal member and the vertical axis shows the surface temperature (temperature at the PFA layer side) of the fixing belt. In FIG. 8, "•" represents the results where the bending phenomenon is not generated and "x" represents the results where the bending phenomenon is generated. For example, in a case where the metal member 22 made of a metal material having the Vickers hardness of approximately 300 Hv was drastically heated so that the temperature of the fixing belt became approximately 190° C., the bending phenomenon was not generated. In a case where the metal member 22 made of a metal material having the Vickers hardness of approximately 300 Hv was drastically heated so that the temperature of the fixing belt became approximately 210° C., the bending phenomenon was generated.

Through the experimental results shown in FIG. 8, in a case where the metal member 22 made of a metal material having the Vickers hardness of approximately 280 Hv is used, regardless of the fixing temperature, it is found that the bending phenomenon is not generated in the metal member 22. In addition, it is found that the bending phenomenon is not generated in the metal member 22 in a case where the metal member 22 is made of a metal material having the Vickers hardness equal to or less than approximately 340 Hv and the fixing temperature is equal to or less than approximately 180° C.

Reflecting the experimental results, in the fixing device 20 of the first embodiment of the present invention, the metal member 22 is set so as to have thickness equal to or less than 0.1 mm and is made of a metal material having the Vickers hardness equal to or less than approximately 280 Hv. More specifically, as a material of the metal member 22, SUS 430, which is ferritic stainless steel, is used. SUS 430 has a density of $7.73\times10^{-3}$ kg/m$^3$, a specific heat of 0.46 kJ/kg° C., a Young's module of 206 Gpa, Vickers hardness of 250 Hv, and a heat capacity rate per unit volume of 3.56. Because of this, it is possible to prevent a deficiency where the heating efficiency of the metal member 22 is improved and the bending phenomenon is generated in the metal member 22.

Nickel has a density of $8.9\times10^{-3}$ kg/m$^3$, a specific heat of 0.439 kJ/kg° C., a Young's module of 210 Gpa, Vickers hardness of 96 Hv, and a heat capacity rate per unit volume of 3.91. SUS 304-1/2H has a density of $7.93\times10^{-3}$ kg/m$^3$, a specific heat of 0.502 kJ/kg° C., a Young's module of 197 Gpa, Vickers hardness of 250 Hv, and a heat capacity rate per unit volume of 3.98.

Thus, according to the first embodiment of the present invention, the amount A of clearance of the metal member 22 and the fixing member 21 is optimized by using the following characteristics. That is, at the warming-up time when heating starts, the metal member 22 provided inside the fixing belt (fixing member) 21 is deformed with the maximum deformation amount $B_{max}$. At the time when the sheet is fed, the stable deformed state with a relatively small deformation amount $B_{ave}$ is maintained. As a result of this, the embodiments of the present invention can provide a fixing device and an image forming apparatus whereby a warming-up time or a first printing time is short; bad fixing does not happen even if a process of the apparatus 20 is made to speed up; heating efficiency of the fixing belt 21 is sufficiently high; and the likelihood of generating a problem where a fixing belt 21 makes sliding contact with the metal member 22 so as to be worn at the time of operation of the image forming apparatus is reduced.

Although the fixing belt 21 having a plural-layers structure is used as the fixing member in the first embodiment of the present invention, an endless fixing film made of polyimide, polyamide, fluororesin, or metal may be used as the fixing member. In this case, by optimizing the clearance amount between the metal member and the fixing film, it is possible to achieve an effect the same as that of the first embodiment of the present invention.

Second Embodiment

Figure 9:
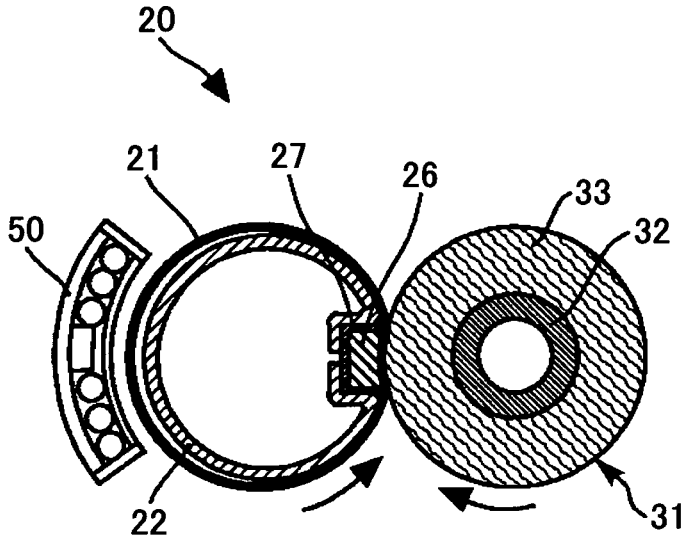
FIG. 9 is a structural view showing a fixing device of a second embodiment of the present invention.

A second embodiment of the present invention is discussed in details with reference to FIG. 9.

FIG. 9 is a structural view showing a fixing device of a second embodiment of the present invention. The fixing device of the second embodiment is different from the fixing device of the first embodiment in that the metal member 22 is heated by using electromagnetic induction in the fixing device of the second embodiment.

As shown in FIG. 9, the fixing device 20 of the second embodiment of the present invention, as well as that of the first embodiment of the present invention, includes the fixing belt 21, the fixating member 26, the metal member 22, the pressing roller 31, the adiabatic member 27, and others. In addition, in the fixing device 20 of the second embodiment of the present invention, as well as that of the first embodiment of the present invention, "A" is equal to or less than "$B_{max}$" and greater than "$B_{ave}$" ("$B_{max}$"≧"A">"$B_{ave}$"), where "A" represents an amount of a clearance at the time of normal temperature between the fixing belt 21 and the metal member 22, "$B_{max}$" represents a maximum amount of deformation generated in the metal member 22 when heating is started by the heater 25 from the normal temperature state, and "$B_{ave}$" represents an amount of stable deformation generated in the metal member 22 when the temperature of the entire metal member 22 becomes even.

An induction heating part 50, instead of the heater 25, is provided in the fixing device 20 of the second embodiment of the present invention. The metal member 22 of the second embodiment of the present invention, unlike the metal member 22 of the first embodiment heated by radiation heat of the heater 25, is heated by using electromagnetic induction with an induction heating part 50.

The induction heating part 50 includes an exciting coil, a core, a core guide, and others. The exciting coil is formed by extending, in a width direction (a perpendicular direction relative to a sheet of FIG. 9), a litz wire where fine wires are bundled, so as to cover a part of the fixing belt 21. The coil guide is made of a resin material having high heat-resistance or the like so as to hold the exciting coil or the core. The core is a half-circular shaped member made of a ferromagnetic body (relative permeability of approximately 1000 through approximately 3000) such as ferrite. The core includes a center core and a side core so that an efficient flux field is formed toward the metal member 22. The core faces the exciting coil extending in the width direction.

The fixing device 20 having the above-mentioned structure is operated as follows.

When the fixing belt 21 is rotated in an arrow direction shown in FIG. 9, the fixing belt 21 is heated in a position where the fixing belt 21 faces the induction heating part 50. More specifically, by flowing a high frequency alternating current through the exciting coil, a magnetic flux field is formed in the periphery of the metal member 22 so as to be alternatively switched in both directions. At this time, an eddy current is generated in the surface of the metal member 22 so that Joule heat is generated by electric resistance of the metal member 22 itself. The metal member 22 is heated by electromagnetic induction based on the Joule heat and the fixing belt 21 is heated by the heated metal member 22.

In order to efficiently heat the metal member 22 by electromagnetic induction, it is preferable that the induction heating part 50 be provided so as to face the entirety in a circumference direction of the metal member 22.

Thus, according to the second embodiment, as well as the first embodiment, of the present invention, the amount A of clearance of the metal member 22 and the fixing member 21 is optimized by using the following characteristics. That is, at the warming-up time when heating starts, the metal member 22 provided inside the fixing belt (fixing member) 21 is deformed with the maximum deformation amount $B_{max}$. At the time when the sheet is fed, the stable deformed state with a relatively small deformation amount $B_{ave}$ is maintained. As a result of this, the embodiments of the present invention can provide a fixing device and an image forming apparatus whereby a warming-up time or a first printing time is short; bad fixing does not happen even if a process of the apparatus 20 is made to speed up; heating efficiency of the fixing belt 21 is sufficiently high; and the likelihood of generating a problem where a fixing belt 21 makes sliding contact with the metal member 22 so as to be worn at the time of operation of the image forming apparatus is reduced.

Although the metal member 22 is heated by electromagnetic induction heating in the second embodiment of the present invention, the metal member 22 may be heated by heat of heating resistor. More specifically, the heating resistor is made to come in contact with a part or an entirety of the internal circumferential surface of the metal member 22.

The heating resistor is a planar heat generating body such as a ceramic heater. An electric power source is connected to both end parts of the planar heat generating body. When an electric current flows through the heating resistor, the temperature of the heating resistor is increased by the electric resistance of the heating resistor so that the metal member 22 that the heating resistor contacts is heated. In addition, the fixing belt 21 is heated by the heated metal member 22.

It is possible to achieve the same effect as those of the first and second embodiments by optimizing the material or thickness of the metal member 22, the amount of clearance between the metal member 22 and the fixing belt 21, and others in these cases as well as the first and second embodiments.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

This patent application is based upon and claims the benefit of priority of Japanese Patent Application No. 2009-29330 filed on Feb. 12, 2009, the entire contents of which are incorporated herein by reference.

The invention claimed is:

1. A fixing device, comprising:

a flexible endless fixing member configured to move in a designated direction and heat a toner image so as to melt the toner image;

a metal member fixedly provided so as to face an internal circumferential surface of the fixing member with a clearance and configured to heat the fixing member, the metal member being heated by a heating member; and a pressing member configured to press and contact the fixing member so as to form a nip part where a recording medium is conveyed, wherein "A" is equal to or less than "$B_{max}$" and greater than "$B_{ave}$" ("$B_{max}$"≧"A">"$B_{ave}$"), where "A" represents an amount of a clearance at the time of normal temperature between the fixing member and the metal member, "$B_{max}$" represents a maximum amount of deformation generated in the metal member when heating is started by the heating member from a normal temperature state, and "$B_{ave}$" represents an amount of stable deformation generated in the metal member when the temperature of the entire metal member becomes even.

2. The fixing device as claimed in claim 1, wherein the metal member has a thickness equal to or less than 0.1 mm, and a Vickers hardness of the metal member is equal to or less than 280 Hv.

3. The fixing device as claimed in claim 1, wherein the metal member is made of ferritic stainless steel.

4. An image forming apparatus, comprising:

a fixing device including a flexible endless fixing member configured to move in a designated direction and heat a toner image so as to melt the toner image;

a metal member fixedly provided so as to face an internal circumferential surface of the fixing member with a clearance and configured to heat the fixing member, the metal member being heated by a heating member; and a pressing member configured to press and contact the fixing member so as to form a nip part where a recording medium is conveyed, wherein "A" is equal to or less than "$B_{max}$" and greater than "$B_{ave}$" ("$B_{max}$"≧"A">"$B_{ave}$"), where "A" represents an amount of a clearance at the time of normal temperature between the fixing member and the metal member, "$B_{max}$" represents a maximum amount of deformation generated in the metal member when heating is started by the heating member from a normal temperature state, and "$B_{ave}$" represents an amount of stable deformation generated in the metal member when the temperature of the entire metal member becomes even.

* * * * *